US005291810A

United States Patent [19]

Lins

[11] Patent Number: 5,291,810

[45] Date of Patent: Mar. 8, 1994

[54] PINCH FREE GRIPPING PLIERS WITH ADJUSTABLE MULTIPLE POSITION GROOVE JOINT AND AN OVERTRAVEL STOP DEVICE

[76] Inventor: Jack Lins, 1817 First Ave. South, Great Falls, Mont. 59401

[21] Appl. No.: 6,363

[22] Filed: Jan. 19, 1993

[51] Int. Cl.[5] ..... B25B 7/04

[52] U.S. Cl. ..... 81/414; 81/411; 81/393

[58] Field of Search ..... 81/405–408, 81/411–413, 393

[56] References Cited

U.S. PATENT DOCUMENTS 4,271,732 6/1981 Vaughan, Jr. ..... 81/414
4,726,265 2/1988 Reich ..... 81/411

FOREIGN PATENT DOCUMENTS 1138718 10/1962 Fed. Rep. of Germany ..... 81/411

*Primary Examiner*—D. S. Meislin

*Attorney, Agent, or Firm*—Wells, St. John, Roberts, Gregory & Matkin

[57] ABSTRACT

Pinch free gripping pliers are described including first and second pivoted legs joined by a pivot bolt. The pivot bolt is mounted to the first leg and is slidably received in an elongated slot in the second leg, thereby enabling the pliers to have multiple jaw opening ranges. An arcuate rib on the shank of one leg engages and meshes with any selected one of several arcuate grooves formed in the second leg, thereby maintaining the setting of the pivot bolt. An overtravel stop member is located on the first leg, facing an edge surface on the second leg that is acutely angled relative to the slot. The overtravel stop member and edge surface engage as the handles of the pliers close, limiting further closing and preventing the handles from coming together closer than a predetermined safety distance. The predetermined safety distance is the same at each of the multiple jaw opening ranges, by provision of the angled edge surface.

1 Claim, 4 Drawing Sheets

PINCH FREE GRIPPING PLIERS WITH ADJUSTABLE MULTIPLE POSITION GROOVE JOINT AND AN OVERTRAVEL STOP DEVICE

BACKGROUND OF INVENTION

This present invention relates to gripping jaw multiple position groove joint pliers wherein, the pivot bolt of the pliers may be slipped in a slot in the shank of one of the plier legs, thereby enabling the jaws to be adjusted to any of several present jaw capacities, and more particularly to the addition of an overtravel stop member on one shank of the pliers and the addition of a variably widened portion to the opposing shank of the pliers, thereby enabling a predetermined safety distance to be maintained between the handles of the pliers in order to prevent hand injury to the user during closing of the handles, making the pliers pinch free in all pivot positions and in all size pliers.

Adjustable gripping jaw multiple position groove joint pliers commonly available comprise a pair of crossed leg members that employ a bolt as the pivot point, however they have a design deficiency that will allow the handles of the pliers to come together and pinch the hand of the user of the pliers in the event the plier jaws accidentally and suddenly slip off of the workpiece they are being used on. Anyone who has ever used groove joint pliers a number of times has probably experienced this mishap. There is no means to limit the inward travel of the plier handles available in the prior art pliers. The present invention comprising a stop device accomplishes protection of the users hand making them pinch free without sacrificing any of the inherent desired operational characteristics of commonly available prior art.

The Vaughan patent 4,271,732 does not accomplish its claims for preventing the closing of the handles without sacrificing inherent desireable operational characteristics of the commonly available prior art multiple position groove joint pliers. Using a 12" pair of pliers as an example, there is not a location that the overtravel stop member can be placed so it will consistently control the closing safety distance. If ⅜" is desired and designed at one pivot position, the closing distance will not be the same in any of the other pivot positions. Consistent control is not possible because of the parallel positioning change that occurs with the handles when a different pivot position of the pliers is selected. The larger the pliers, the greater the discrepancy between the closing distance each position will be. Using a 16" pair of pliers as another example, there is no location that the overtravel stop member can be placed and still maintain an adequate safety closing distance in all pivot positions. This control inadequacy is because the length of the overtravel stop member is limited to that which is necessary to permit the jaws to close and touch in pivot position #1. In some selected positions, this inconsistent control may hold the handles an inordinate distance apart which in turn would reduce the jaw opening range of the selected position. In summation, the overtravel stop member of the Vaughn patent provides inconsistent limiting control on small pliers and does not accomplish the concept of limiting the closing of the handles in larger size pliers.

The Reich patent 4,726,265 does not accomplish its claims for preventing the closing of the handles to a predetermined safety distance without sacrificing inherent desirable operational characteristics of the commonly available prior art multiple position groove joint pliers. These sacrifices are self defeating for application to the prior art. As an example, the stop strip, by being placed on the sliding surface of the slotted shank sacrifices approximately 50% of the arcurate grooves normally present in said shank thereby reducing the maximum jaw capacity of any given size of pliers. A 16" pair of commonly available prior art has a maximum jaw capacity of approximately 4½"; the same size pliers employing the Reich patent would have a maximum jaw capacity of only approximately 2". The Reich patent drawings FIG. 2 shows that the S safety distance is inordinately wide. As the selected pivot positions are moved up to pivot position #2 from pivot position #5 the S distance increases. Consistent control is not possible because of the parallel positioning change that occurs with the handles when a different pivot position is selected. This inordinately wide distance between the handles reduces the jaw range capacity in each selected position. The placement of the stop member on the sliding surface of the shank with the bolt hole requires that all of the arcurate grooves on one side of the slot of the slotted shank be eliminated; this reduces the bearing surface between the arcurate rib and the arcurate grooves by approximately 50%.

CROSS REFERENCE OF OTHER PATENTS

Patent 4,271,732; Patent issued Jun. 9, 1981; Inventor James E. Vaughn, Jr.

Patent 4,726,265; Patent issued Feb. 23, 1988; Inventor Rolf Reich.

DESIGNATION OF PARTS NUMERALS

Figure 1:
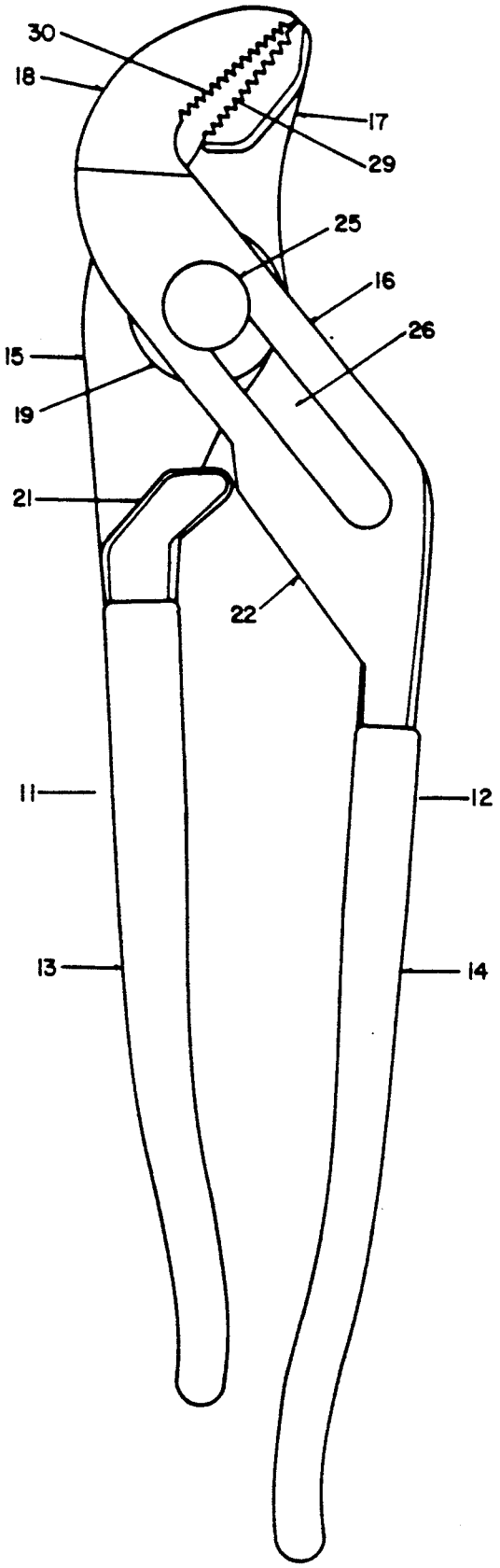
FIG. 1 plan view of pliers in 1st joint position.
Figure 2:
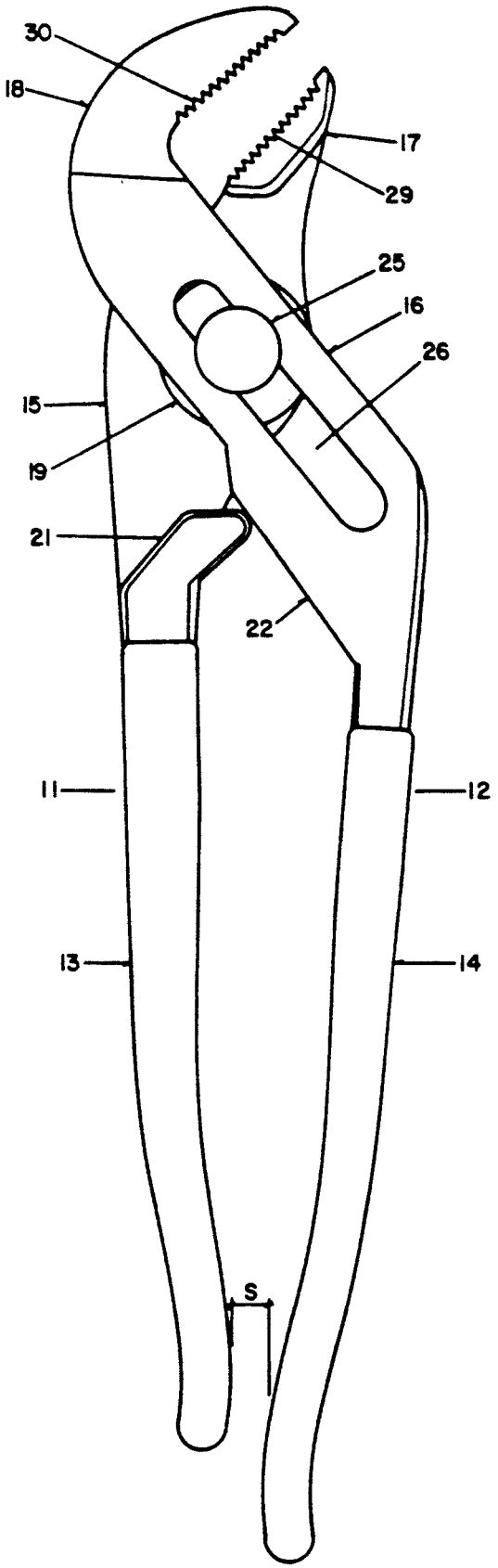
FIG. 2 plan view of pliers in 2nd joint position.
Figure 3:
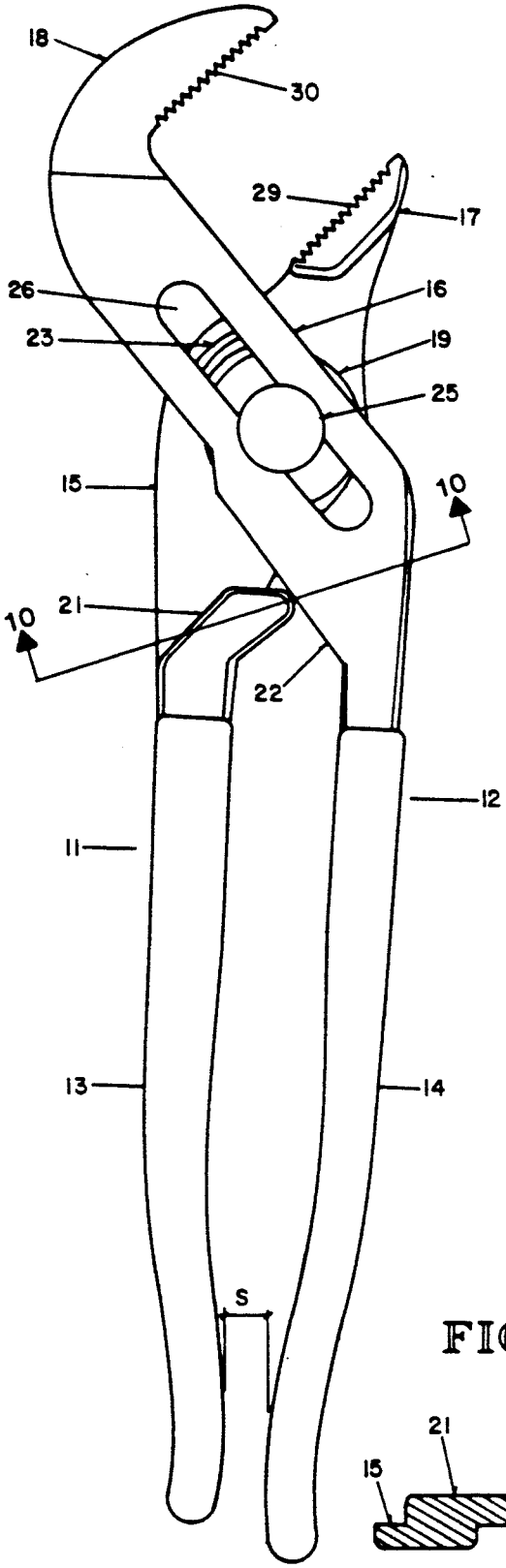
FIG. 3 plan view of pliers in 4th joint position.
Figure 10:
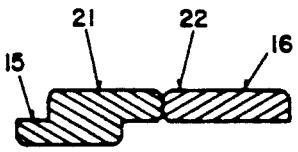
FIG. 10 cross section A—A showing contact of stop device members
Figure 4:
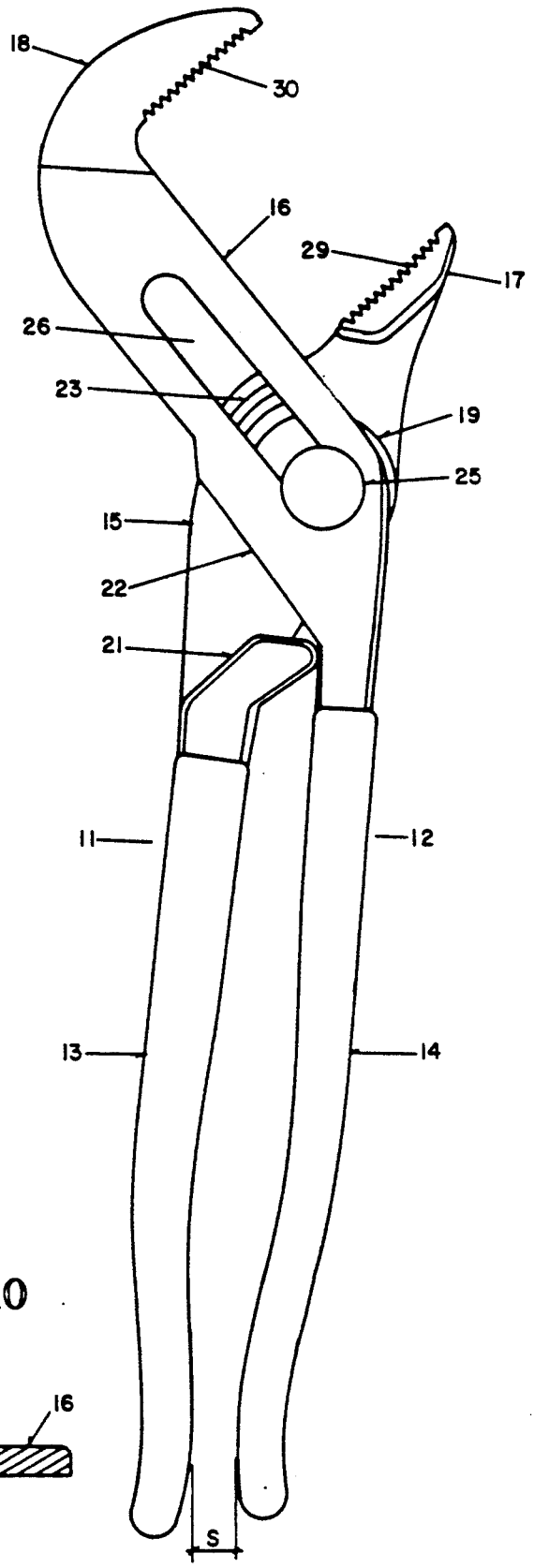
FIG. 4 plan view of pliers in 6th joint position.
Figure 6:
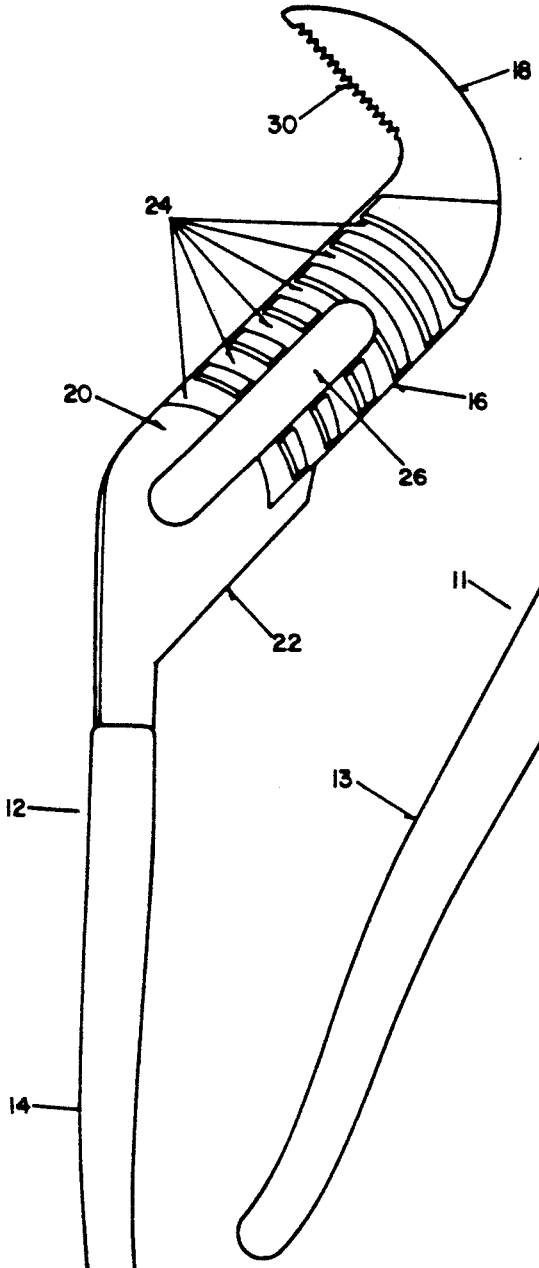
FIG. 6 inside face view of second plier leg.
Figure 5:
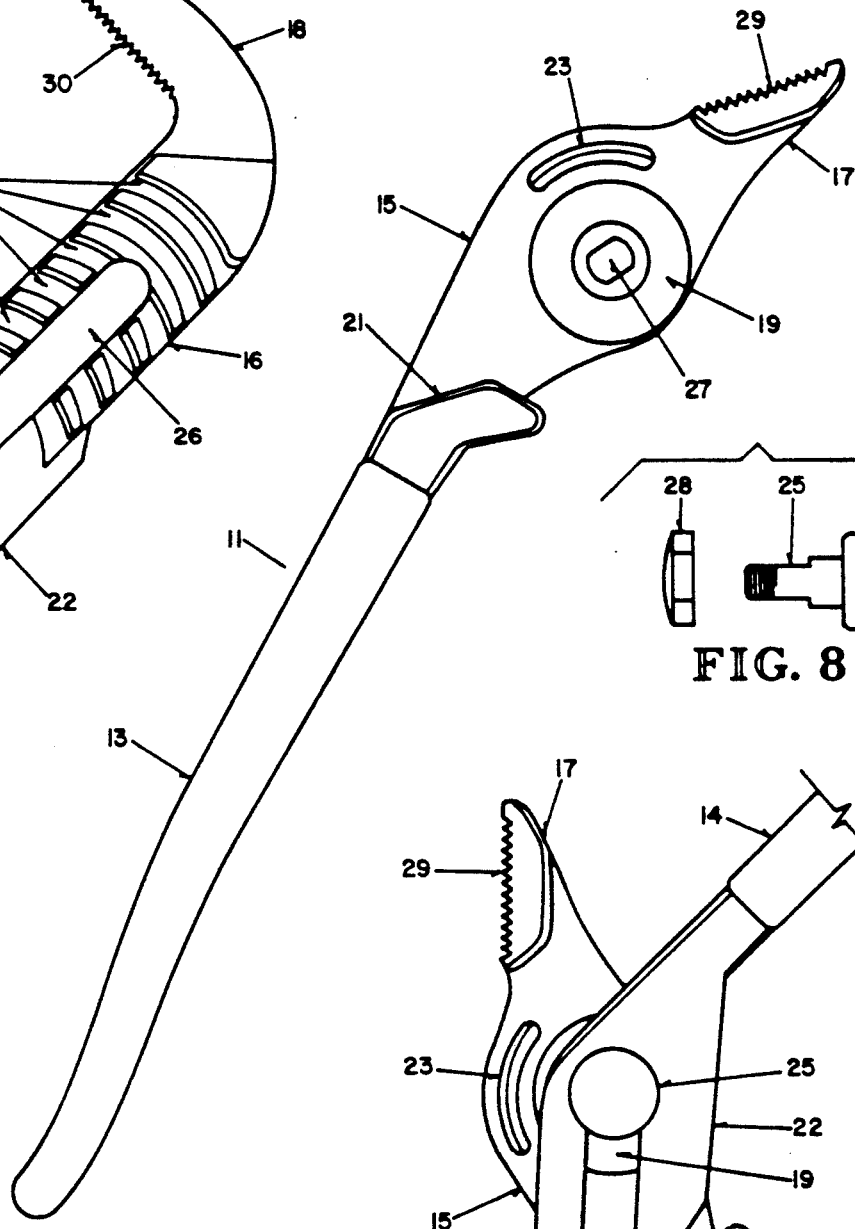
FIG. 5 inside face view of first plier leg.
Figure 8:
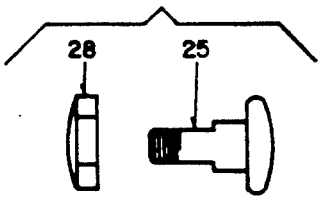
FIG. 8 view of pivot bolt and nut.
Figure 7:
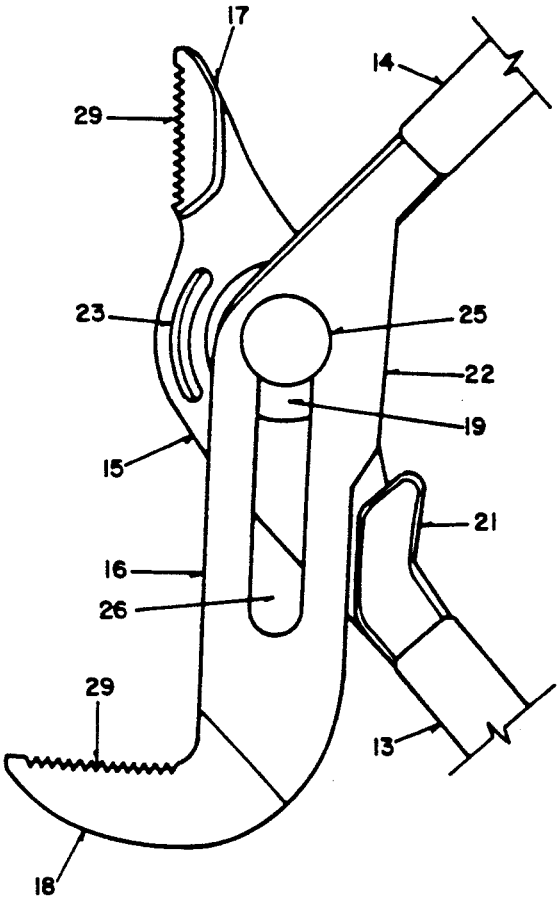
FIG. 7 plan view of pliers in joint selection mode.
Figure 9:
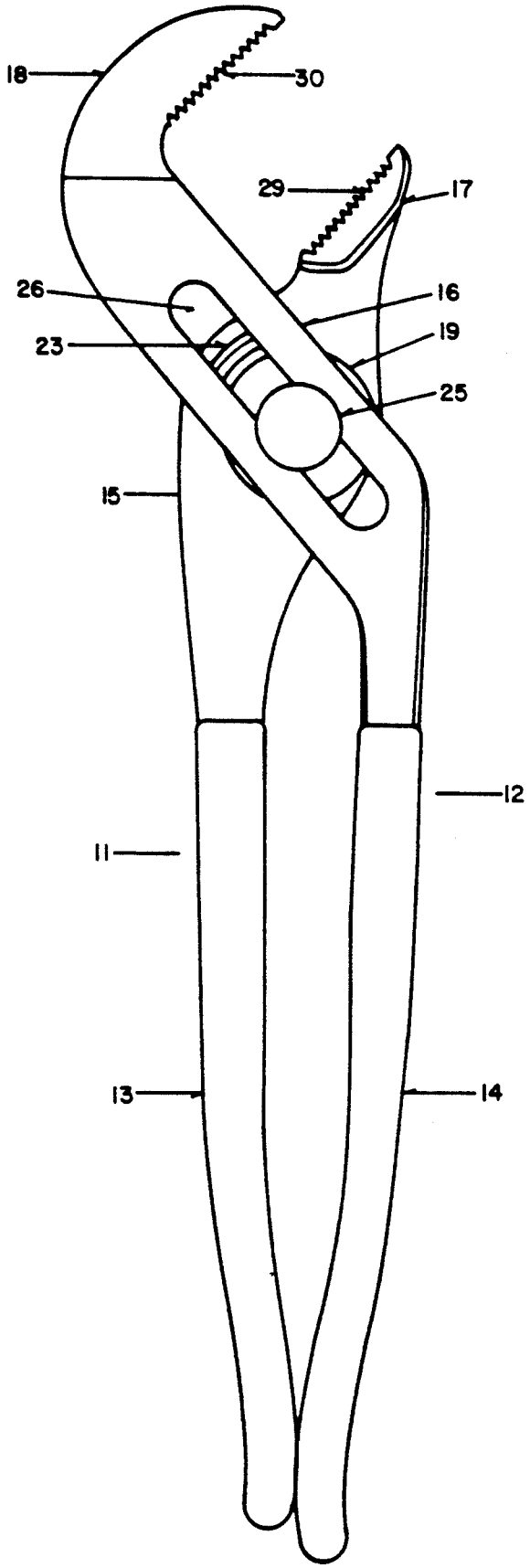
FIG. 9 plan view of commonly available prior art pliers in 4th joint position.

11 first leg
12 second leg
13 first handle member
14 second handle member
15 first shank member
16 second shank member
17 first jaw member
18 second jaw member
19 first sliding surface
20 second sliding surface
21 overtravel stop member
22 edge portion of shank
23 arcurate rib
24 arcurate grooves
25 pivot bolt
26 slot in second shank
27 hole in first shank
28 pivot nut
29 first jaw face
30 second jaw face S safety distance

DESCRIPTION OF THE PREFERRED EMBODIMENT

Referring to the drawing wherein like numerals designate like parts throughout the several views, there is shown gripping multiple position groove joint pliers. The gripping pliers include a first leg 11 and a second leg 12. Each leg 11 and 12 are comprised of three integral members, the handles 13 and 14, the shanks 15 and 16, and the jaws 17 and 18 respectively.

Both first jaw 17 as well as second jaw 18 have oppositely oriented exposed faces 29 and 30 respectively, that may be serrated, aiding in the secure gripping of the workpiece.

First shank member 15 and second shank member 16 lap each other and are loosely pivoted together by means of a pivot bolt 25, said pivot bolt 25 is secured in its position in a hole 27 in first shank member 15 by means of a pivot nut 28.

Sliding surface 19 of first shank member 15 and sliding surface 20 of second shank member 16 act as a thrust bearing for pivoting and adjustment action of plier legs 11 and 12.

Pivot bolt 25 is free to slip in a slot 26 located in second shank member 16. Said pivot bolt 25 and first leg 11 move as one thereby permitting multiple positioning of jaws 17 and 18.

A raised arcurate rib 23 on first shank member 15 near and concentric to pivot bolt 25 engages and meshes with any one of arcurate grooves 24 in sliding surface 20 of second shank member 16, maintaining the selected setting of said pivot bolt 25.

Adjustment of leg members 11 and 12 is accomplished by first rotating counter clockwise the top mounted second leg member 12 to a position essentially at a right angle to the bottom mounted first leg member 11. The top mounted second leg member 12 is then slid to any selected open position along the bottom mounted leg member 11 being guided past pivot bolt 25 in the process. The top mounted leg member 12 is then rotated clockwise to its previous position with the legs 11 and 12 essentially parallel, and the pliers are then ready to be used in the chosen jaw setting.

A raised integral overtravel stop member 21 located on first shank member 15 at a moderate handlewardly distance from pivot bolt 25 comes in contact with an edge 22 during the closing motion of handles 13 and 14 preventing said handles 13 and 14 from closing completely, leaving a predetermined safety distance S between said handles 13 and 14 thereby preventing pinching and injury to the user of the pliers in the event jaws 17 and 18 accidentally and suddenly slip off the workpiece said pliers are being used on. The edge 22, by being acutely angled in relation to the slot 26 as shown, so that at each point of contact with overtravel stop member 21 provides a consistent predetermined safety distance S for all pivot positions of said pliers without sacrificing any of the existing desirable operational characteristics of commonly available prior art pliers.

What is claimed is:

1. Pinch free gripping pliers, comprising:

a first leg including a first handle section, a first jaw section, and a first shank section joining the first handle section and jaw section;

a pivot bolt mounted to the first shank section;

a second leg including a second handle section, a second jaw section and a second shank section joining the second handle section and jaw section;

wherein the second shank section is elongated and includes an elongated slot formed therethrough, slidably receiving the pivot bolt such that the first and second legs will pivot about the pivot bolt between open and closed positions, and such that the second leg will slide relative to the first leg along the slot;

a raised arcuate rib on the first shank;

arcuate grooves spaced apart longitudinally on the second shank, and positioned thereon to slidably receive the arcuate rib and thereby set the jaws at any one of a plurality of jaw settings;

an overtravel stop on the first shank section, projecting toward the second shank section;

wherein the second shank section includes an edge surface facing the overtravel stop of the first shank section and formed at an acute angle to the slot so the distance between the edge surface and the slot increases progressively in the direction of the second handle section such that the overtravel stop and edge surface limit pivotal motion of the handles together beyond a prescribed distance at any selected spacing jaw setting.

* * * * *